United States Patent [19]

Lauricella

[11] Patent Number: 5,064,118

[45] Date of Patent: Nov. 12, 1991

[54] METHOD AND APPARATUS FOR CONTROLLING THE THICKNESS OF A HOT-DIP COATING

[75] Inventor: Charles Lauricella, Blasdell, N.Y.

[73] Assignee: Bethlehem Steel Corporation, Bethlehem, Pa.

[21] Appl. No.: 634,249

[22] Filed: Dec. 26, 1990

[51] Int. Cl.[5] ..... B05B 1/32

[52] U.S. Cl. ..... 239/1; 239/455

[58] Field of Search ..... 239/1, 451, 455, 597, 239/598

[56] References Cited

U.S. PATENT DOCUMENTS

| | | | |
|---|---|---|---|
| 811,854 | 2/1906 | Lee | 117/102 |
| 2,139,628 | 12/1938 | Terry | 239/597 |
| 2,940,418 | 6/1960 | Penrod et al. | 239/455 |
| 3,141,194 | 7/1964 | Jester | 18/15 |
| 3,314,163 | 4/1967 | Kohler | 34/155 |
| 3,436,022 | 4/1969 | Ernst | 239/455 |
| 3,459,587 | 8/1969 | Hunter et al. | 117/102 |
| 3,499,418 | 3/1970 | Mayhew | 118/4 |
| 3,753,418 | 8/1973 | Roncan | 118/63 |
| 3,808,033 | 4/1974 | Mayhew | 117/102 |
| 3,917,888 | 11/1975 | Beam et al. | 427/433 |
| 3,932,683 | 1/1976 | Robins et al. | 427/349 |
| 4,153,006 | 5/1979 | Thornton et al. | 118/63 |
| 4,270,702 | 6/1981 | Nicholson | 239/455 |
| 4,515,313 | 5/1985 | Cavanagh | 239/455 |
| 4,708,629 | 11/1987 | Kasamatsu | 239/455 |

OTHER PUBLICATIONS

The Development of Air Coating Control for Continuous Strip Galvanizing by J. L. Butter, et al., Iron & Steel Engineer, Feb. 1970.

*Primary Examiner*—Andres Kashnikow
*Assistant Examiner*—Karen B. Merritt
*Attorney, Agent, or Firm*—Harold I. Masteller, Jr.

[57] ABSTRACT

A method and apparatus for controlling the thickness of a hot-dip coating. The apparatus comprising a jet wipe nozzle having a gas discharge opening capable of changing the shape of both elongated, opposed edges, of the opening by inserting shims between the nozzle halves and sequentially engaging jacking means to produce a desired gas discharge opening gap profile.

13 Claims, 3 Drawing Sheets

METHOD AND APPARATUS FOR CONTROLLING THE THICKNESS OF A HOT-DIP COATING

BACKGROUND OF THE INVENTION

It is well-known in the art of hot-dip coating of steel strip that uniform coatings can be achieved through the use of jet wipe nozzles, or air knives. It is also known that the shape of the gas discharge opening in such jet wipe nozzles affects the flow and thickness of the hot-dip coating from edge to edge across the width of the steel strip. Studies have shown that the velocity of the gas being expelled from such discharge opening will be uneven along the width of the opening if the opposed edges of the opening are parallel to each other. When the gas discharge opening has such a parallel gap profile, the hot-dip coating on the finished product tends to have a lighter coating at the center of the strip and a heavier coating at the edges of the strip. It is also well-known that when the shape of the gap profile is changed to a uniform slope from its center to a wider gap at its edge, the hot-dip coating will be more uniform in thickness across the width of the coated product.

Heretofore one method of changing the shape of the gap profile was through the use of a nozzle insert system as described in an article entitled "The Development of Air Coating Control for Continuous Strip Galvanizing", Pages 83–85 of the February, 1970 issue of *Iron and Steel Engineer,* and in U.S. Pat. No. 3,917,888 granted Nov. 4, 1975 to Beam. The insert system disclosed in the article and the Beam patent discloses using inserts which have been machined to a desired center to edge slope. To change the shape of the gap profile an insert, having the proper machined slope, is selected and is pushed into one side of the gas discharge opening while at the same time forcing a previously used insert out the opposite side of the opening. Such a system is effective in shaping the gap profile of the discharge opening but is limited by the number of different machined inserts available to an operator.

A second method of changing the shape of the gap profile is disclosed in U.S. Pat. No. 3,753,418 granted Aug. 21, 1973 to Roncan. Starting at line 38 in column 5, and as shown in FIG. 2 of the drawings, the lower lip 24 is provided with spaced pins 27 which can be drawn downward at selected distances, which can be different from pin to pin, so that the thickness of the fluid blade 6 may be adjusted as desired for its entire width, Roncan, however, neither discloses nor suggests a method for changing the shape of both opposed edges in a gas discharge opening.

And, finally, a third method of changing the shape of the gap profile of the gas discharge opening in a jet wipe nozzle is through the use of machined shims placed between the nozzle halves as disclosed in U.S. Pat. No 4,153,006 granted May 8, 1979 to Thornton, et al. In column 19, starting at line 61, and as shown in FIG. 10, Thornton discloses using tapered shims to regulate the gap profile of the gas discharge opening. Thornton neither teaches nor suggests a means for permitting further adjustment to the gap profile after the jet wipe nozzle is assembled.

Although the above patents and publication disclose effective solutions for changing the gap profile shape of a gas discharge opening in a jet wipe nozzle, they are either limited to a selected number of adjustments as dictated by the available machined inserts or shims, or provide adjustment for only one edge of the gas discharge opening.

SUMMARY OF THE INVENTION

It is therefore an object of this invention to provide a jet wipe nozzle assembly having means for changing the shape of the gap profile by changing the contour of more than one edge of the gas discharge opening.

It is a further object of this invention to provide a method for obtaining a desired gap profile in increments along the width of the gas discharge opening in a jet wipe nozzle assembly.

It is still a further object of this invention to provide a means for adjusting two opposed edges of a discharge opening to comprise a gap profile having a greater gap at two ends of the opening than at the center of the opening.

It has been discovered that the foregoing objects can be achieved by providing a jet wipe nozzle assembly having a flat shim inserted between the nozzle halves, and, plurality of jack screws and jack seats spaced along the width of one side of the nozzle assembly opposite the gas discharge opening where the jack screws are sequentially tightened to bear against the jack seats to achieve a desired gap profile.

DESCRIPTION OF THE PREFERRED EMBODIMENT

Figure 1:
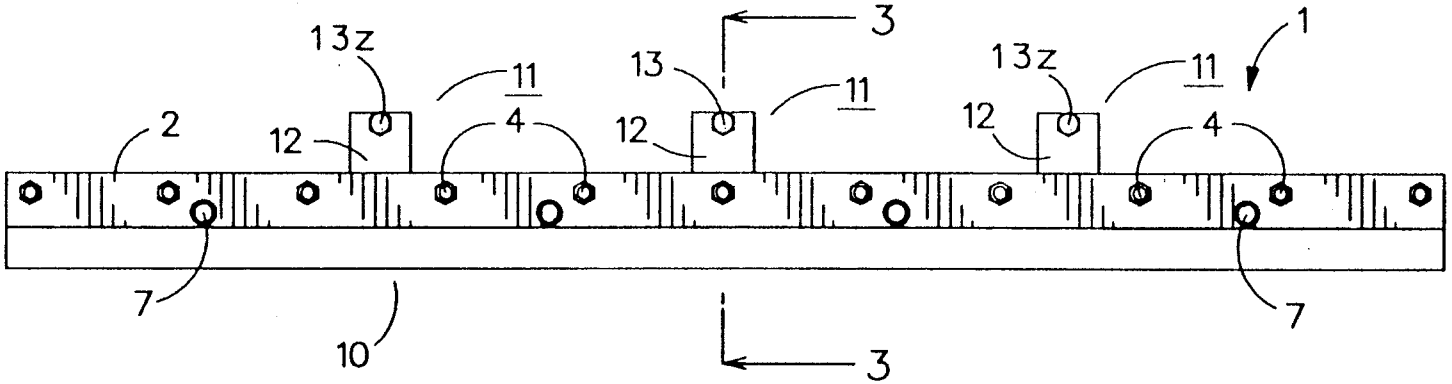
FIG. 1 is a plan view of the preferred embodiment of the present jet wipe nozzle invention.
Figure 2:
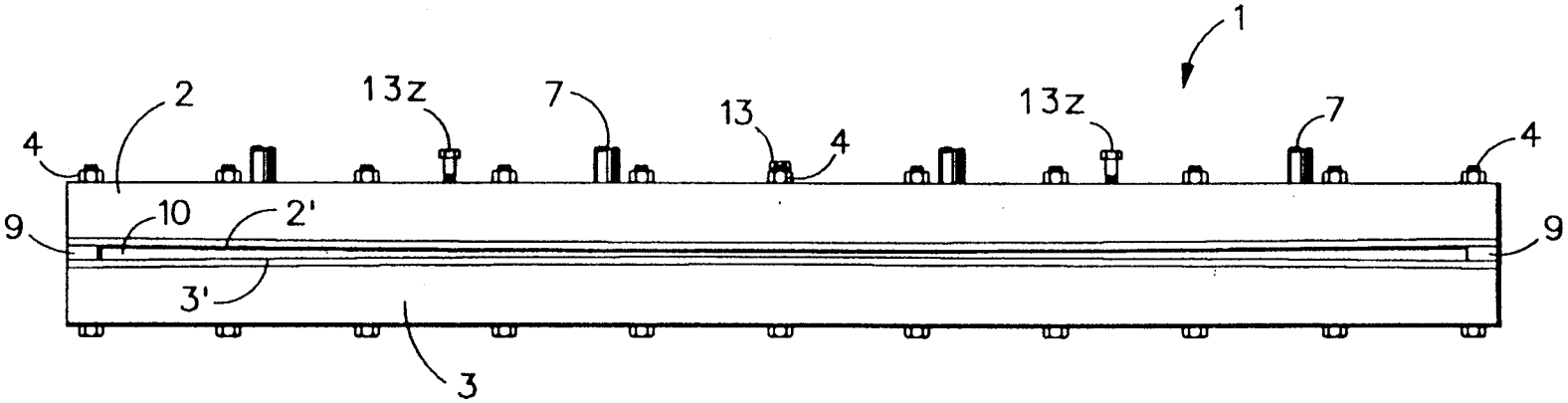
FIG. 2 is a front elevation view of the jet wipe nozzle assembly of FIG. 1 showing the gap profile along the width of the gas discharge opening.
Figure 3:
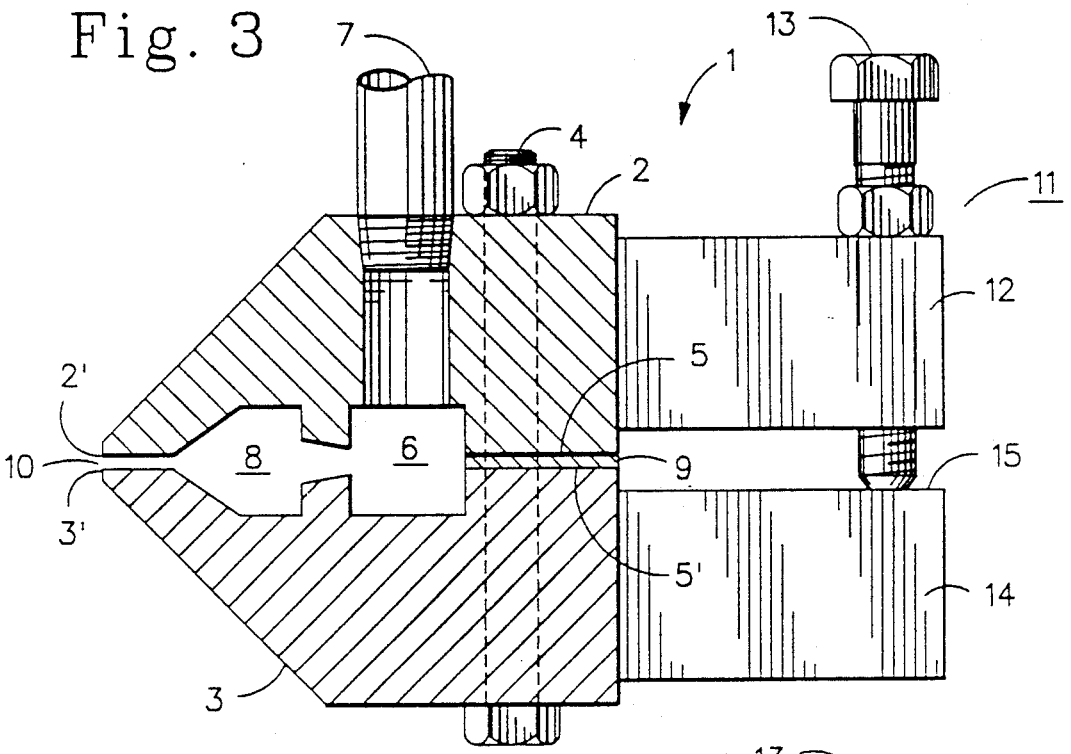
FIG. 3 is a cross-sectional view taken along the lines 3—3 of FIG. 1 showing the gap at the gas discharge opening prior to shaping the gap profile.
Figure 4:
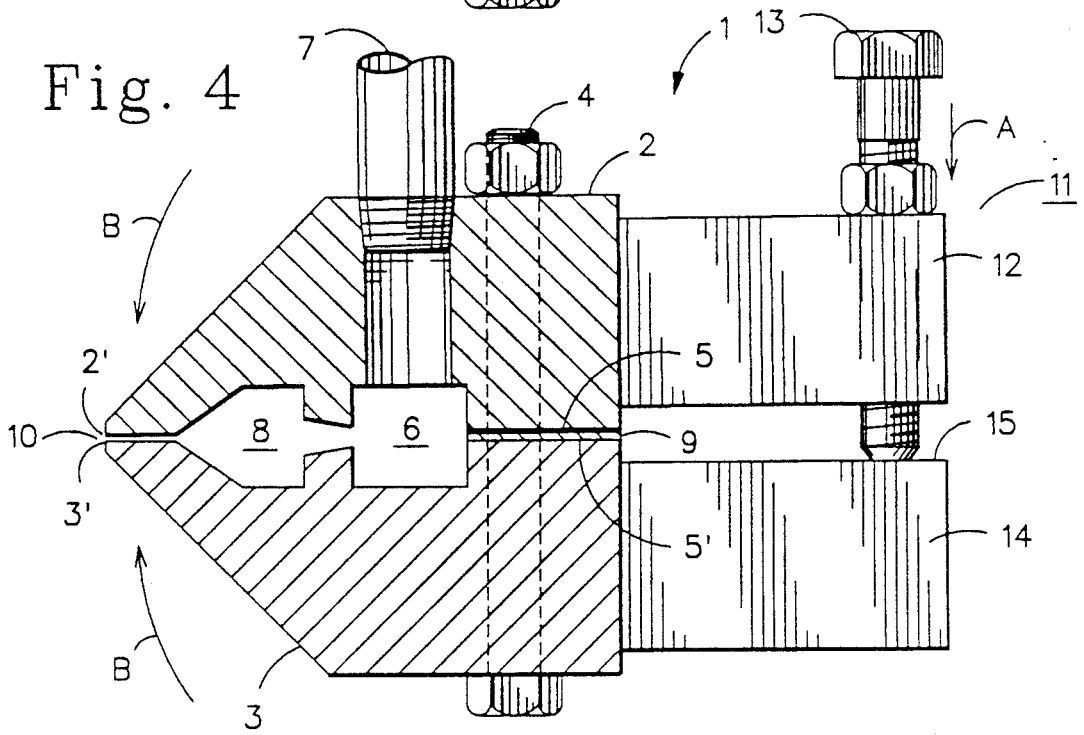
FIG. 4 is a cross-sectional view similar to FIG. 3 showing a smaller gap at the gas discharge opening after tightening jack screws.
Figure 5:
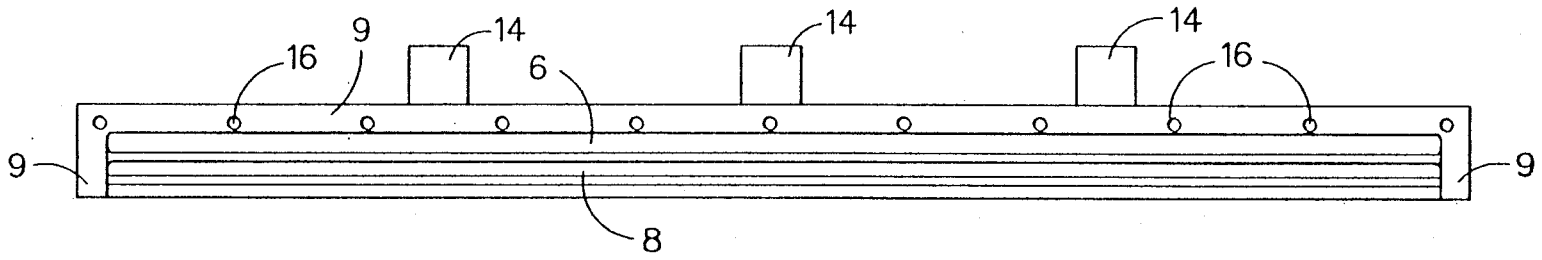
FIG. 5 is a plan view showing the lower half of the jet wipe nozzle assembly with a flat shim in place.

As shown in FIGS. 1–4 of the drawings, the preferred embodiment of the present invention comprises a jet wipe nozzle assembly 1 having a pair of nozzle halves 2 and 3 held together in vertical alignment by a plurality of fasteners 4 spaced along the width of the jet wipe nozzle assembly 1. As shown in FIGS. 3 and 4, the vertically aligned nozzle halves 2 and 3 include opposite hand machined grooves and beveled surfaces extending along the width of adjacent surfaces 5 and 5' to form a gas inlet chamber 6, supplied by gas feed line 7, a gas equalization chamber 8 and a tapered connecting gas passageway there between.

A three sided flat shim 9, having a longer side connecting two shorter sides, is inserted between adjacent surfaces 5 and 5' of the jet wipe nozzle assembly 1. With its longer side being adjacent the gas inlet chamber 6, flat shim 9 provides a gas tight seal along three sides of the jet wipe nozzle assembly and the spaced apart nozzle halves 2 and 3 provide a gas discharge opening 10 along the fourth side adjacent the gas equalization chamber 8. The thickness of the flat shim 9 should be at least equal to or slightly greater than the maximum desired gap between the surfaces 5 and 5' at the discharge opening 10, the preferred thickness being 0.002" greater than the desired gap.

The jet wipe nozzle assembly 1 further includes a plurality of jacking means 11 extending from the side opposite the nozzle discharge opening 10 and spaced along the width of the jet wipe nozzle assembly. Each jacking means 11 includes a jack block 12 extending from one nozzle half and provided with a threaded hole for receiving a jack screw 13, and, a jack seat 14, corresponding to jack block 12 and extending from the second nozzle half. Jack seat 14 includes a bearing surface 15 for engagement with jack screw 13.

A gap profile, defined by elongated edges 2' and 3', of the gas discharge opening 10 can be adjusted by either tightening or loosening the jack screws 13. As shown in FIG. 3, with flat shim 9 and nozzle halves 2 and 3 held together by fasteners 4, and the jack screws 13 resting upon bearing surfaces 15 of the jack seats 14, the gap profile of the gas discharge opening 10 is substantially equal to the thickness of the flat shim 9. Tightening jack screws 13, to bear against the jack seats 14 as shown by the downward pointing arrow "A" in FIG. 4, creates a torsional moment about fasteners 4 and causes edges 2' and 3' to simultaneously move toward each other as shown by the directional arrows "B". Conversely, loosening jack screws 13 reduces the torsional moment about fasteners 4 and causes edges 2' and 3' to move apart and readjust the gas discharge opening 10 to have a wider gap profile.

In order to set the proper gap profile along the gas discharge opening 10, and achieve a uniformly thick hot-dip coating across the width of the coated product, the spaced apart surfaces 5 and 5' of the nozzle halves and the top and bottom surfaces of the flat shim 9 are first cleaned to remove any dirt or grit prior to assembling the jet wipe nozzle as shown in FIG. 3. Flat shim 9 is inserted between the nozzle halves 2 and 3 and fasteners 4 are inserted through holes 16 provided. The plurality of fasteners 4 are torqued equally to hold the assembly together and provide a parallel gap profile along edges 2' and 3'.

Jack screw 13, of the center jacking means 11, is tightened to close the gap between edges 2' and 3' at the central portion of the gap profile until the gap measurement is equal to or about 0.003" greater than the final desired gap size. The side jack screws **13*z*, of each side jacking means 11 located nearest to each end of the gap profile, are torqued to bear equally against their respective jack seats 14** and gap measurements are checked along the width of the gap profile. Sequential tightening, starting with the center jack and ending with the side jacks, continues until gap measurements, along the width of the gap profile, indicate that the desired gap profile has been achieved.

Figure 6:
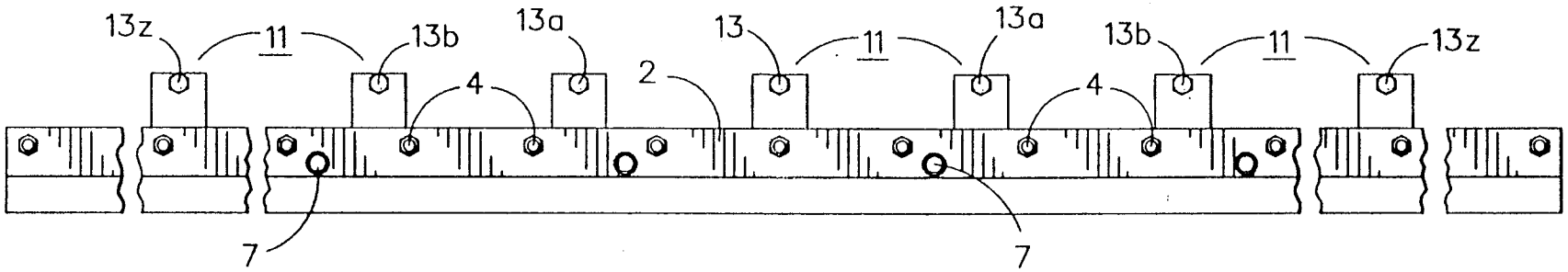
FIG. 6 is a plan view similar to FIG. 1 showing an alternate embodiment of the present invention having more than three jacking means.

Jet wipe nozzle **1*a*, shown in FIG. 6, is an alternate embodiment of the invention having more than three jacking means 11. The procedure for adjusting the gap profile for nozzle 1*a* is similar to the procedure disclosed above for jet wipe nozzle assembly 1. A three sided flat shim 9 is inserted between the nozzle halves and the fasteners 4 are inserted and equally torqued. The center jack screw 13 is tightened until the center gap is closed to a measurement equal to or about 0.003" larger than the desired gap size. Each remaining pair of jack screws, starting with 13*a* and ending with 13*z* is sequentially tightened to bear against their respective jack seats and both jack screws in a pair of jack means are equally torqued to give a smooth radial contour. After the tightening sequence has proceeded from the center jack screw 13 to the side jack screws the gap size is measured across the width of the gap profile and the sequential tightening of the jack screws 13 through 13*z*** and measurement of the gap profile is repeated until the desired final gap size is achieved.

I claim:

1. A jet wipe nozzle comprising:

a) a first nozzle half adjacent a second nozzle half, a flat shim inserted between said first and said second nozzle halves, a plurality of fasteners spaced along the width of a first side portion of said jet wipe nozzle, said fasteners attaching said first nozzle half, said second nozzle half and said flat shim together, b) a gas discharge opening opposite said first side portion, said gas discharge opening extending along the width of a second side portion of said jet wipe nozzle, said gas discharge opening including a first adjustable edge spaced from a second adjustable edge, and c) a plurality of jacks extending from said first side portion of said jet wipe nozzle, said jacks providing means for simultaneously moving said first adjustable edge and said second adjustable edge toward or away from each other.

2. The jet wipe nozzle according to claim 1 wherein each jack comprises a jack block extending from said first nozzle half, said jack block provided with a threaded hole therethrough for receiving a jack screw, and a jack seat extending from said second nozzle half, said jack seat including a bearing surface for engagement with said jack screw.

3. The jet wipe nozzle according to claim 1 wherein the flat shim extends along three sides of the jet wipe nozzle.

4. The jet wipe nozzle according to claim 3 wherein the thickness of said flat shim is at least equal to 0.002" greater than a desired gap between said first adjustable edge and said second adjustable edge of said gas discharge opening.

5. The jet wipe nozzle according to claim 3 wherein the thickness of said flat shim is 0.002" greater than a desired gap between said first adjustable edge and said second adjustable edge of said gas discharge opening.

6. A method for assembling and adjusting the gas discharge opening of a jet wipe nozzle comprising the steps of:

a) inserting a flat shim between a first nozzle half and a second nozzle half and attaching said first and said second nozzle halves and said flat shim together with a plurality of fasteners inserted through holes provided, b) torquing equally each said fastener and adjusting to parallel a first adjustable edge and a second adjustable edge of a gas discharge opening, c) tightening a center jack screw of a plurality of jack screws of a jack block extending from said first nozzle half to bear against a jack seat extending from said second nozzle half and moving said first adjustable edge and said second adjustable edge toward each other, d) tightening a pair of side jack screws to bear against corresponding jack seats, e) checking gap measurement along the width of said gap profile, and f) repeating steps (c), (d) and (e) until a desired gap profile is achieved.

7. The method according to claim 6 wherein the step (c) includes tightening said center jack screw until the gap between said first and said second adjustable edges is at least equal to 0.003" greater than a desired final gap.

8. The method according to claim 6 wherein the step (c) includes tightening said center jack screw until the gap between said first and said second adjustable edges is 0.003" greater than a desired final gap.

9. The method according to claim 6 wherein the step (d) includes equally torquing each said side jack screw to equally bear against said jack seats.

10. The method according to claim 6 wherein the step (c) includes sequentially tightening a plurality of jack screws to bear against the jack seats said sequential tightening starting with the center most jack screw and ending with the side jack screws furthermost from the center.

11. The method according to claim 10 wherein the step includes tightening said center jack screw until the gap between said first and said second adjustable edges is at least equal to 0.003" greater than a desired final gap.

12. The method according to claim 10 wherein the step includes tightening said center jack screw until the gap between said first and said second adjustable edges is 0.003" greater than a desired final gap.

13. The method according to claim 10 wherein the step includes equally torquing each said side jack screw to equally bear against said jack seats.

* * * * *